United States Patent [19]

Ishii

[11] 4,301,448

[45] Nov. 17, 1981

[54] GONG STRIKING MECHANISM

[76] Inventor: Tadashi Ishii, c/o Kobishi Electric Co., Ltd. No. 4-6, Kaminakazato 3-chome, Kita-ku, Tokyo, Japan

[21] Appl. No.: 142,707

[22] Filed: Apr. 22, 1980

[51] Int. Cl.[3] ..... G10K 1/065

[52] U.S. Cl. ..... 340/392; 340/390; 340/399; 340/402

[58] Field of Search ..... 340/390, 399, 402, 392; 84/103; 116/105

[56] References Cited

U.S. PATENT DOCUMENTS 1,692,518 11/1928 Sotak ..... 340/399

2,840,176 6/1958 Davis ..... 340/390

3,076,960 2/1963 Knutson ..... 340/402

*Primary Examiner*—Harold I. Pitts

*Attorney, Agent, or Firm*—Darby & Darby

[57] ABSTRACT

A gong striking mechanism is provided, which comprises a driving electric motor mounted on a frame within a gong, and conversion means rotationally connected directly or indirectly to the motor shaft for converting continuous rotational motion of the motor shaft to reciprocal gong striking motion. In a preferred embodiment of the invention the conversion means comprises an eccentric cylinder fixed to the motor shaft, and a hammer made of hollow cylinder in spaced internal arrangement with the eccentric cylinder to absorb impact strength and improve sound volume.

1 Claim, 10 Drawing Figures

GONG STRIKING MECHANISM

BACKGROUND OF THE INVENTION

This invention relates to an electric bell of the type which is driven by a motor as for use in a fire bell, an alarm bell or the like, and more particularly to a gong striking mechanism which is driven by a motor to strike a gong.

In a conventional electric bell as shown in FIG. 1, a pivotting plate 2, is rotationally fixed to the shaft 1 of motor 7. A counter-weight 3 is attached to one end of the plate 2 and at the other end of the plate 2 a striking hammer 4 is arranged in a slot 5 for forward and backward movement against a gong 6 upon the rotation of a motor 7. The location of the striking hammer 4 varies each time it strikes the gong 6 so that the weight balance between the two ends of the pivotting plate 2 with respect to the rotary shaft 1 of the motor 7 fluctuates during the hammer striking motion.

Moreover, when the motor 7 starts to rotate and the striking hammer 4 strikes the gong 6, the relatively long plate 2 having the counter-weight 3 at one end and the striking hammer 4 at the other end causes the motor shaft 1 to bend due to the large torque imparted on the shaft. In addition, the plate 2 moves gradually away from the shaft 1 due to the absence of a provision for fixing the shaft 1 to the plate 2. This is especially the case when the shaft is relatively small in diameter and insusceptible for the insertion of a fixing means, such as a pin, to fix the shaft 1 and the plate 2. Therefore, the bell of the type described is disadvantageous since the rotation of the motor 7 is not uniform and tends to fluctuate. Further, the shaft 1 is subjected to bending force which causes irreparable damages thereto.

In order to overcome the above disadvantage, a bell as shown in FIG. 2 has been proposed. This bell contains a supporting plate 15 and a semi-circular gong 13 attached thereto. An electric motor 10 is mounted on the supporting plate 15. The end of the shaft 9 of the motor 10 extending from the motor is fixedly attached by a cam 8 to one end of a crank rod 11. The crank rod 11 is positioned perpendicular to the axial direction of the shaft 9. The other end of the crank rod 11 is attached to one end of a spring plate 12. The spring plate 12 is positioned perpendicular to the crank rod 11 and parallel to the axis of the shaft 9. The other end of the spring plate is fixed to the supporting plate 15. A hammer 14 is attached to the spring plate 12 between the supporting plate 15 and crank rod 11. The hammer 14 is positioned perpendicular to the spring plate 12 facing in the direction of the gong 13. When the motor 10 is energized the rotational movement of shaft 9 is converted to a reciprocal motion on the crank rod 11 by means of cam 8. The reciprocal motion of the crank rod 11 is transmitted to the spring plate 12 and hammer 14, the hammer thus striking the gong 13.

In the bell as described above, however, some problems exist such as the plurality of assembly processes required, and the cost of the bell. In addition, it is difficult to adjust to get an optimum sound volume.

Accordingly, it is an object of this invention to provide a novel gong striking mechanism in which all of the above-described drawbacks accompanying a conventional gong striking mechanism are overcome. Another object of the invention is to provide a mechanism which is reliable, and which employs simple constitutional elements to eliminate difficulties in manufacturing and in adjusting bell sound volume.

With the above and other objects in view, the invention provides a gong striking mechanism comprising a driving electric motor mounted on a frame within a gong, and conversion means rotationally connected directly or indirectly to the motor shaft for converting continuous rotational motion of the motor shaft to reciprocal gong striking motion. Preferably the conversion means comprises an eccentric cylinder fixed to the motor shaft, and a hammer made of hollow cylinder in spaced arrangement with the eccentric cylinder. The conversion means may be either a combination of a cylindrical cam and a hammer fixed to the end of a cam follower engaging with a groove formed on the cam surface, or a combination of gears and pivotting plates between which at least one hammer is rotatably mounted around an axis in a spaced arrangement between the axis and the hammer.

The novel features which are considered characteristic of the invention are set forth in the appended claims. This invention itself, however, as well as other objects and advantages thereof will be best understood by reference to the following detailed description of illustrative embodiments, when read in conjunction with the accompanying drawings.

BRIEF DESCRIPTION OF THE DRAWINGS

In the accompanying drawings.

DETAILED DESCRIPTION OF THE INVENTION

Figure 1:
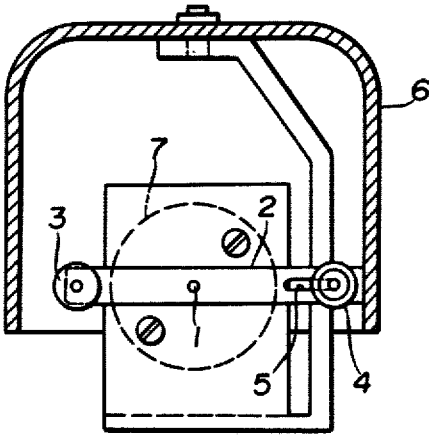
FIGS. 1 and 2 are a sectional side view and a bottom view illustrating examples of a conventional motor driven type bell.
Figure 2:
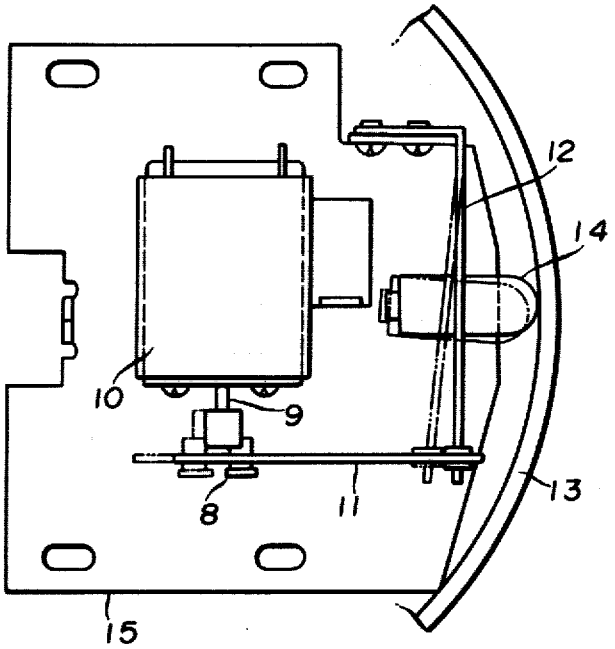
Figure 3:
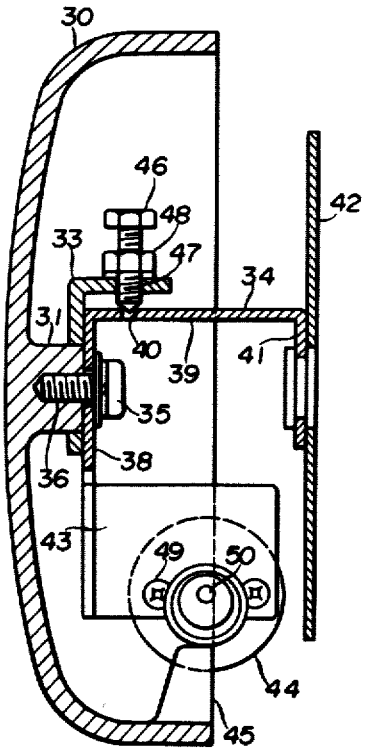
FIGS. 3 and 4 are a bottom view and a sectional side view showing one embodiment of this invention, respectively.
Figure 4:
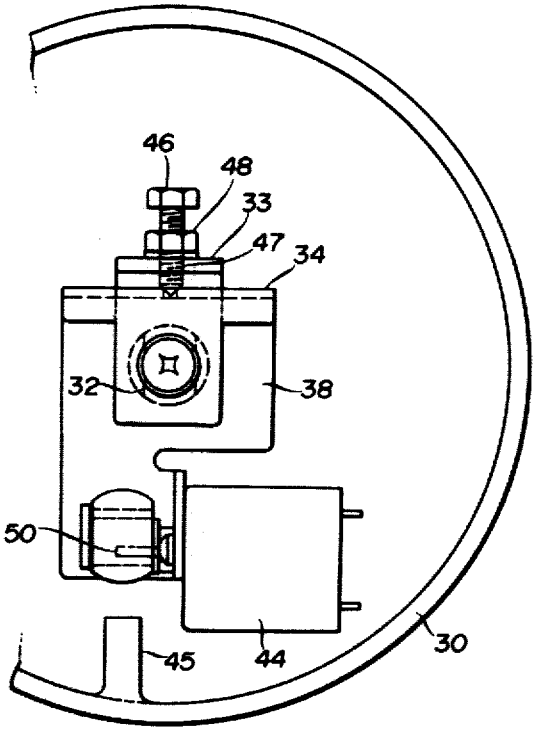
Figure 6:
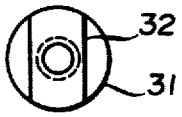
FIGS. 5 and 6 are a plan view showing an adjusting plate and an edge protrusion in the embodiment respectively.
Figure 7:
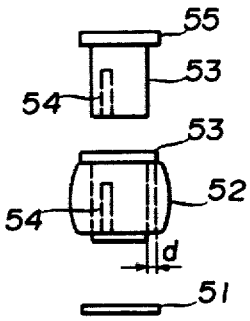
FIG. 7 is an exploded view of the part of FIGS. 3 and 4 to better illustrate the construction thereof.
Figure 5:
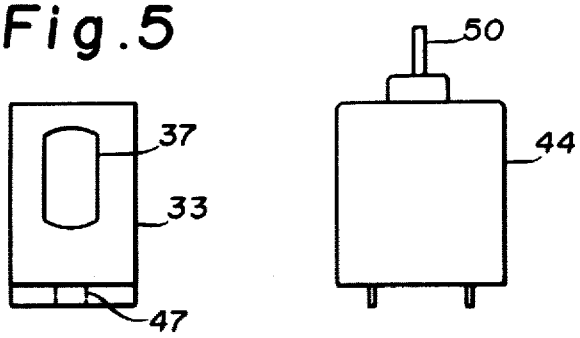

A first embodiment of this invention is shown in FIGS. 3, 4, 5, 6 and 7 in which reference numeral 30 designates a gong. The gong 30 is made of iron in the form of a cup or a semisphere. A mounting section 31 protruding from the central portion of the inner wall of the gong 30 is formed in such a shape as it receives around its top edge protrusion 32 a perpendicularly bended plate 33 and a supporting plate 34, the plates 23 and 34 being fixedly mounted on the top edge protrusion 32 as by a screw 35 which is threaded into a threaded bore 36 formed in the mounting section 31. The top edge protrusion 32 of the mounting section 31 has substantially rectangular cross section so that it may associate with the corresponding rectangular opening 37 of the bended plate 33.

The supporting plate 34 has a base wall 38 attached to the edge protrusion 32 as by the screw 35, an adjusting wall 39 made integral with the base wall 38 and formed thereon with an adjusting hole 40, a supporting wall 41 susceptible of engaging with a supporting plate 42 for supporting the bell assembly to an appropriate location, and a motor mounting wall 43 on which a motor 44 is disposed in proximity arrangement with the bell striking extension 45 formed at the inner surface of the gong 30. The adjusting hole 40 is adapted to engage with a bolt 46 which passes through hole 47 formed at the corresponding position of the bended plate 33, and the bolt may be fixed properly as by a nut 48. The motor 44 mounted on the mounting wall 43 as by a screw 49 has around its shaft 50, referring to FIG. 7 in detail, a washer 51, a hammer 52, and a collar 53, respectively in assembly order. The motor shaft 50 is fixedly connected to the collar 53 as by the insertion of the shaft 50 in an elongated bore 54 offset from the center of the collar 53. The hammer 52 is disposed around the collar 53 separated from the collar 53 by in a predetermined space distance (d). The hammer 52 is prevented from moving in its position relative to the collar 52 by a rim 55 integrally made at the top edge thereof. The space distance (d) together with the offset of the elongated bore 54 is designed to get the maximum volume sound.

The operation of the gong striking mechanism thus constructed will be described.

Upon energization of the motor, its shaft 50 is rotated, and the collar 53 is therefore rotated around its offset bore 54. As a result, the hammer 52 strikes the gong 30 each time the lobe portion of the eccentric collar 53 i.e., that portion of the collar furthest away from the offset bore 54, comes adjacent to the bell striking extension 45 of the gong 30. Upon movement of the hammer 54 away from the extension 45, the force imparted on the hammer during striking is absorbed in the space distance (d), thereby causing no damage to the motor shaft 50 by eliminating the possible bending force applied to the shaft.

Figure 8:
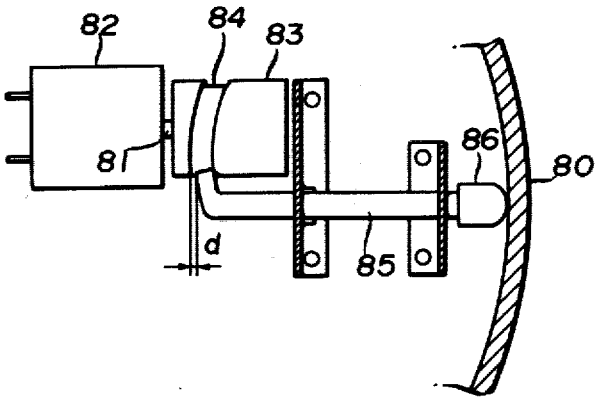
FIGS. 8, 9 and 10 are a plan view showing respectively another embodiment of the invention.

Another embodiment of the invention will be described with reference to FIG. 8 in which reference numeral 80 designates a gong which is made of iron in the form of a cup or a semi-sphere to the first embodiment described above. Attached to the motor shaft 81, of a motor 82, is a cylindrical cam 83. Around the surface of the cam 83 there is a groove 84 of predetermined size into which the base of a cam follower rod 85 rests. The width of the base of follower rod 85 is narrower than the width of the groove 85 by a preselected amount (d). A hammer 86, fixed to the other end of the rod 85 is used to strike the gong 80. The bell thus constructed will absorb the striking impact force exerted on hammer 86 and rod 85 by the spaced distance between the base of the rod 85 and the groove 84. As a result, the impact force imparted to the rod 85 during the bell striking motion is absorbed and causes no damage against the motor shaft 81, thereby preventing the motor shaft from bending.

Figure 9:
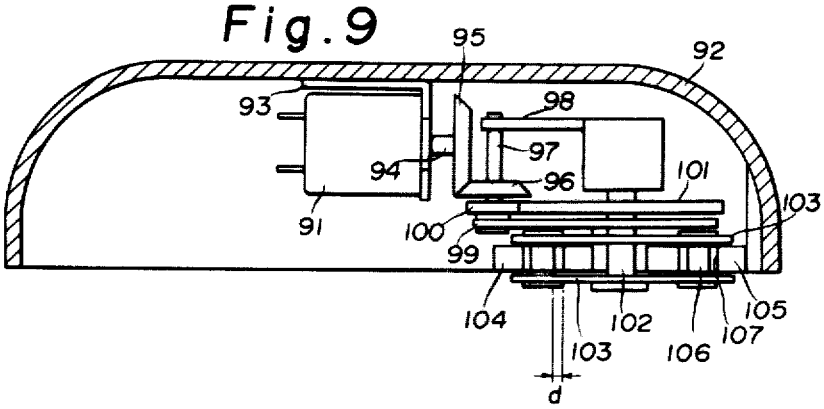
Figure 10:
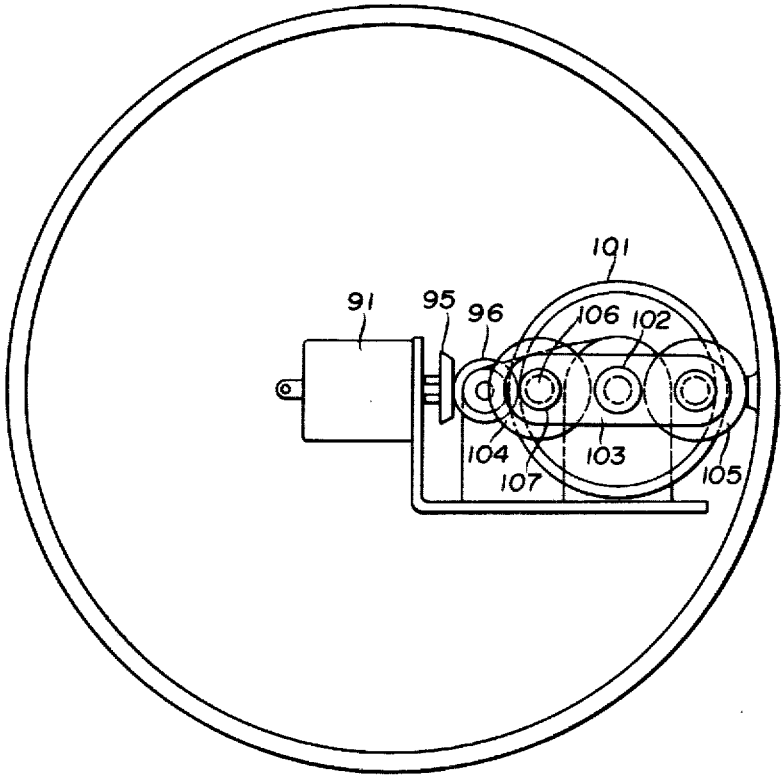

An another embodiment of the invention is shown in FIGS. 9 and 10. In this embodiment, a motor 91 is secured at the center of an inner wall of a gong 92 as by a fixing plate 93. Fixedly attached to the motor shaft 94 is a bevel gear 95 which engages with a second bevel gear 96 to transmit the rotational movement of the motor shaft 94 to a pivotting shaft 97 perpendicular to the axial direction of the motor shaft 94. The pivoting shaft 97 is rotationally held between supporting plates 98, 99. A speed changing gear 100 mounted around the pivoting shaft 97 is urged to rotate so as to further rotate another speed changing gear 101 mating with the gear 100. A driving shaft 102, to which the gear 101 is fixed, forces pivoting plates 103 to rotate circular hollow hammers 104, 105 are held symmetrically apart from shaft 102 and adjacent to the both ends of the plates 103. The hammers 104, 105 are held to pivoting plates 103 by means of central cores 106 which are offsset by distance (d) from the inner wall 107 of each of hollow hammers 104, 105 such that the space distance (d) between their central core 106 and the inner wall 107 of the hammers may absorb impact force exerted on the hammers 104, 105 during bell striking operation.

As is described above, it is a feature of the invention to provide a bell striking mechanism in which driving power for a hammer to strike a gong is supplied from a motor by a conversion means rotationally connected directly or indirectly to the motor shaft. The conversion means preferably comprises an eccentric cylinder fixed to the motor shaft, and the hammer made of hollow cylinder in spaced arrangement with this eccentric cylinder so that impact force imparted on the hammer during bell striking operation may be absorbed to some extent, thereby causing no damages to the motor shaft.

Having described our invention as related to the embodiment shown in the accompanying drawings, it is our intention that the invention is not limited by any of the details of description, unless otherwise specified, but rather is construed broadly within its spirit and scope as set out in the accompanying claims.

What is claimed is:

1. A gong striking mechanism comprising:

an electric motor mounted on a frame within a gong, said motor having a shaft, said shaft rotatably engaging an eccentric collar, and a hollow hammer having an outer surface adjacent to said gong and an inner surface disposed around said eccentric collar and spaced apart from said collar to absorb impact force and produce improved gong volume when the motion of the shaft, eccentric collar and hammer causes the outer surface of said hammer to strike the gong.

* * * * *